US005660699A

United States Patent [19]

Saito et al.

[11] Patent Number: 5,660,699

[45] Date of Patent: Aug. 26, 1997

[54] ELECTROPLATING APPARATUS

[75] Inventors: Tadashi Saito; Atsushi Sato; Hisashi Misumi, all of Tochigi-ken, Japan

[73] Assignee: Kao Corporation, Tokyo, Japan

[21] Appl. No.: 603,246

[22] Filed: Feb. 16, 1996

[30] Foreign Application Priority Data

| | | | |
|---|---|---|---|
| Feb. 20, 1995 | [JP] | Japan | 7-031096 |
| May 30, 1995 | [JP] | Japan | 7-132149 |
| Jun. 6, 1995 | [JP] | Japan | 7-139484 |

[51] Int. Cl.[6] ..... C25D 17/06

[52] U.S. Cl. ..... 204/297; 269/21; 204/297 R

[58] Field of Search ..... 204/297 M, 297 R; 269/21; 205/68

[56] References Cited

U.S. PATENT DOCUMENTS

| | | | |
|---|---|---|---|
| 3,536,594 | 10/1970 | Pritchard | 205/123 |
| 4,381,964 | 5/1983 | Lock | 156/344 |
| 4,856,766 | 8/1989 | Huberts | 269/21 |
| 5,167,792 | 12/1992 | Kamitakahara | 205/68 |

FOREIGN PATENT DOCUMENTS

| | | |
|---|---|---|
| 56-9141 | 1/1981 | Japan . |

*Primary Examiner*—John Niebling
*Assistant Examiner*—Brendan Mee
*Attorney, Agent, or Firm*—Oblon, Spivak, McClelland, Maier & Neustadt, P.C.

[57] ABSTRACT

An electroplating apparatus has a cathode base for supporting a substrate, and a clamper for clamping a peripheral edge portion of the substrate against the cathode base. A plating solution is supplied onto the substrate so that the surface of the substrate is plated. A negative pressure source clamps the substrate by drawing the clamper under a negative pressure through a suction conduit.

19 Claims, 6 Drawing Sheets

ELECTROPLATING APPARATUS

BACKGROUND OF THE INVENTION

1. Field of the Invention

This invention relates to an electroplating apparatus for supplying a plating solution to an upper surface of a substrate in order to plate the surface.

2. Discussion of Background

As is known, in the process of mastering a CD, data prepared by pre-mastering are recorded on a pre-mastered CD or the like. Based on this, first, a laser beam irradiates for exposure a photosensitive agent, which has been applied to the surface of a glass disc, for the purpose of making a glass master. In a developing process, a pit is formed on a resist surface, and then a metal master is made from this glass master by electroless plating. Subsequently, a metal mother is made from this metal master by electric plating, and finally a stamper is made from this metal mother by electric plating.

A conventional technique for performing the mastering process is known as a CD mastering apparatus comprising an electroplating apparatus including a cathode base having a recess on its upper end face and adapted to support a substrate, and a clamper disposed in the recess of the cathode base and adapted to clamp a peripheral edge portion of the substrate together with the cathode base through a contract ring. A plating solution is supplied onto the substrate so that plating is applied to the surface.

In the electroplating apparatus constituting the CD mastering apparatus, since a twist lock mechanism is disposed between the clamper and the cathode base so that the clamper and the cathode base are mechanically tightened to clamp the substrate which is to be subjected to plating, the clamping force is varied as the temperature is changed. As a result, a uniform clamping force is unobtainable. Further, since a frictional loss occurs when the substrate is tightened by the clamper, a strong clamping force is unobtainable.

Owing to such a variation of clamping force, etc., plating solution tends to enter a gap formed between the cathode base or contact ring and the substrate, and components of the plating solution are precipitated on the cathode base, etc. In an extreme case, not only the substrate but also the cathode base or contact ring are plated. If the growth of the deposit caused by the plating solution or the plating on the cathode base or contact ring is left as it is, a non-uniform current density results. This can be a cause for non-uniform thickness of the plating. Moreover, the overall resistance is increased due to a partially insufficient contact relation and the output voltage of a constant current power source connected to the electroplating apparatus increases. Because of this, a safety circuit is activated to stop the activation of the electroplating apparatus, thereby interrupting the operation in some instances. Furthermore, due to a local concentration of current, the substrate and the cathode substrate or contact ring sometimes suffer from a burn.

Accordingly, heretofore, it was necessary to wipe out the deposit caused by plating, or the plating grown on the cathode base or contact ring whenever the substrate is exchanged, in order to prevent a nonuniform deposition, interruption of an operation and a quenching loss of the substrate, etc. Consequently, the maintenance work is complicated at the time the substrate is exchanged.

SUMMARY OF THE INVENTION

It is an object of the present invention to provide an electroplating apparatus, in which complicated maintenance work is not required at the time a substrate is exchanged and the substrate can be subjected to plating in a stable manner.

In this specification, the term "cathode base" refers to a member composed of a secondary base and a primary base. Also, the terms "secondary base" and "cathode electrode" refer to the same member, and the terms "primary base" and "body" refer to the same member.

The invention has achieved the above object by providing an electroplating apparatus comprising a cathode base for supporting a substrate, and a clamper for clamping a peripheral edge portion of the substrate together with the cathode base, with a plating solution being supplied onto the substrate so that the surface of the substrate is plated. The electroplating apparatus further comprises a negative pressure source for clamping the substrate by drawing the clamper under a negative pressure through a suction conduit.

The invention also provides an electroplating apparatus where the suction conduit is provided on the cathode base.

The invention also provides an electroplating apparatus where the cathode base and the clamper include mutually contacted side surfaces, and opposing surfaces continuous with the side surface portions and opposed to each other, respectively. The cathode base and the clamper further include a gap formed between the opposing surfaces which communicates with the suction conduit during a drawing operation by the negative pressure source.

The invention also provides an electroplating apparatus which further comprises a pressure source for pressurizing a gap formed between the cathode base and the clamper under the effect of a pressurized gas through a feed conduit.

The invention further provides an electroplating apparatus, where packings are arranged between the side surface portions of the cathode base and the side surface portions of the clamper, respectively.

The invention also provides an electroplating apparatus comprising a cathode base for supporting a substrate, and a clamper for clamping a peripheral edge portion of the substrate together with the cathode base, with a plating solution being supplied onto the substrate so that the surface of the substrate is plated. The electroplating apparatus further comprises a pressure source for pressurizing a gap formed between the cathode base and the clamper under the effect of pressurized gas through a feed conduit, the gap communicating with a gap formed between the cathode base or clamper and the peripheral edge portion of the substrate.

The invention has achieved the above object by providing an electroplating apparatus comprising a cathode electrode for supporting a substrate, a body disposed below the cathode electrode for moving upwardly and downwardly relative to the cathode electrode, and a clamper mounted on the body and adapted to clamp a peripheral edge portion of the substrate together with the cathode electrode. The electroplating apparatus further comprises a pressure source for supplying compressed air through a first feed conduit so that the body and the clamper are moved downwardly with respect to the cathode electrode to clamp the substrate.

The invention further provides an electroplating apparatus where a chamber is provided on a lower surface of the cathode electrode or on an upper surface of the body, the first feed conduit communicates with the chamber, and compressed air is supplied into the chamber.

The invention further provides an electroplating apparatus where a cylinder is provided on a lower surface of the cathode electrode or on an upper surface of the body, a piston is provided within the cylinder, and the first feed conduit communicates with the cylinder. Compressed air is supplied into the cylinder through the first feed conduit so that the piston moves upwardly to contact a lower surface of the cathode electrode and so that the body and the clamper move downwardly with respect to the cathode electrode to clamp the substrate.

The invention further provides an electroplating apparatus wherein packing is interposed between the body and the clamper, the body being provided with a second feed conduit one end of which faces the packing, the packing being urged through the second feed conduit so that the body and the clamper are sealed.

In the electroplating apparatus, the peripheral edge portion of the substrate is reliably clamped by the cathode base and the clamper, as the clamper is drawn by the negative pressure source through the suction conduit. In that state, a plating solution is supplied onto the substrate and plating is applied to the surface of the substrate by this plating solution. At that time, since the substrate is clamped by the negative drawing force, a stable clamping state can be maintained irrespective of temperature change.

In the electroplating apparatus, since the suction conduit is provided in the cathode base, the external structure of the apparatus does not become complicated, and the conduit does not hinder the mounting or dismounting of the clamper in addition to the action of the electroplating apparatus described above.

In the electroplating apparatus, since a gap is formed between the opposing surfaces of the clamper and the cathode base at the time the clamper is drawn by the negative pressure source, the negative drawing force uniformly acts on the overall opposing surfaces of the clamper by the negative pressure source through this gap in addition to the action in the electroplating apparatus described above. Further, owing to the provision of the gap, when the substrate is clamped under the effect of the drawing force of the negative pressure source, room for the cathode base and the clamper to move is left between the opposing surfaces.

In the electroplating apparatus, since the gap formed between the cathode base and the clamper, which gap communicates with the gap formed between the cathode base or clamper and the peripheral edge portion of the substrate, is pressed by a pressurized gas from the pressure source through the feed conduit in addition to the action in the electroplating apparatus described above, entry of the plating solution into the peripheral edge portion of the substrate is reliably prevented.

In the electroplating apparatus, since any leak of the negative drawing force of the negative pressure source can be prevented by the packing disposed between the side surface portion of the clamper and the side surface portion of the cathode base in addition to the action in the electroplating apparatus described above, the substrate can more reliably be clamped.

In the electroplating apparatus, the substrate is supported by the cathode base and also the peripheral edge portion of the substrate is reliably clamped by the cathode base and the clamper. Since the gap formed between the cathode base and the clamper, which communicates with the gap formed between the cathode base or clamper and the peripheral edge portion of the substrate, is pressed by a pressurized gas from the pressure source through the feed conduit, entry of the plating solution into the peripheral edge portion of the substrate can reliably be prevented. In that state, a plating solution is supplied onto the substrate so that plating is applied to the surface of the substrate.

In the electroplating apparatus, since air pressure is supplied through the first feed conduit and the body and clamper are moved downwardly relative to the cathode electrode in order to clamp the substrate, a uniform clamping force can be obtained irrespective of temperature change.

In the electroplating apparatus, since compressed air is supplied into the chamber provided between the cathode electrode and the body so as to move the body and the clamper, the pressure can be applied uniformly to the inside of the chamber provided between the cathode electrode and the body.

In the electroplating apparatus, air pressure is supplied into the cylinder through the first feed conduit, the piston is caused to move upwardly to contact a lower surface of the cathode electrode and the body and clamper are moved downwardly by its reaction relative to the cathode electrode in order to clamp the substrate. Accordingly, a uniform clamping force can be obtained irrespective of temperature change.

In the electroplating apparatus, since the gap formed between the body and the clamper is sealed by urging the packing with air pressure supplied through the second feed conduit in addition to the action in the electroplating apparatus described above, intimate sealing between the body and the clamper can be enhanced without being subjected to any adverse effect from temperature change.

DETAILED DESCRIPTION OF THE PREFERRED EMBODIMENTS

Several embodiments of the present invention will now be described in detail with reference to the accompanying drawings.

Figure 1:
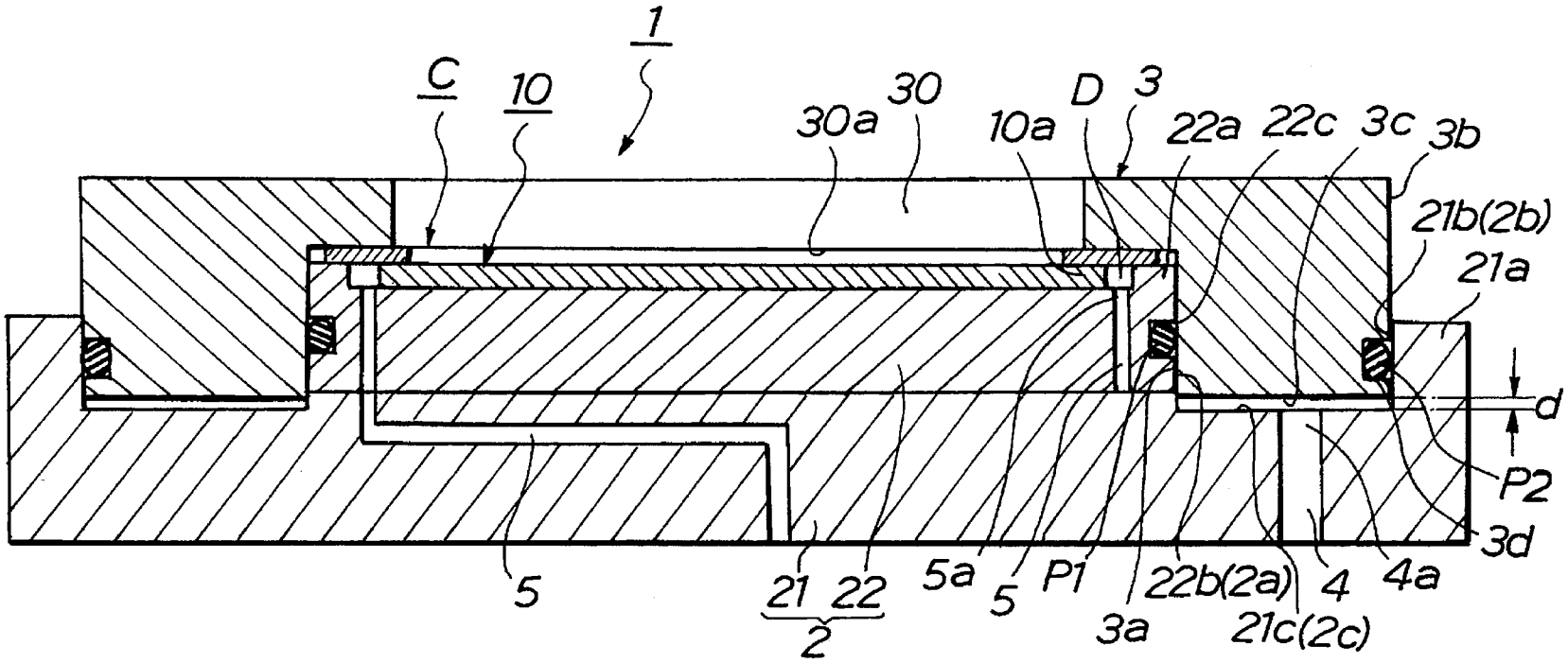
FIG. 1 is a front sectional view of a first embodiment of an electroplating apparatus according to the present invention.
Figure 2:
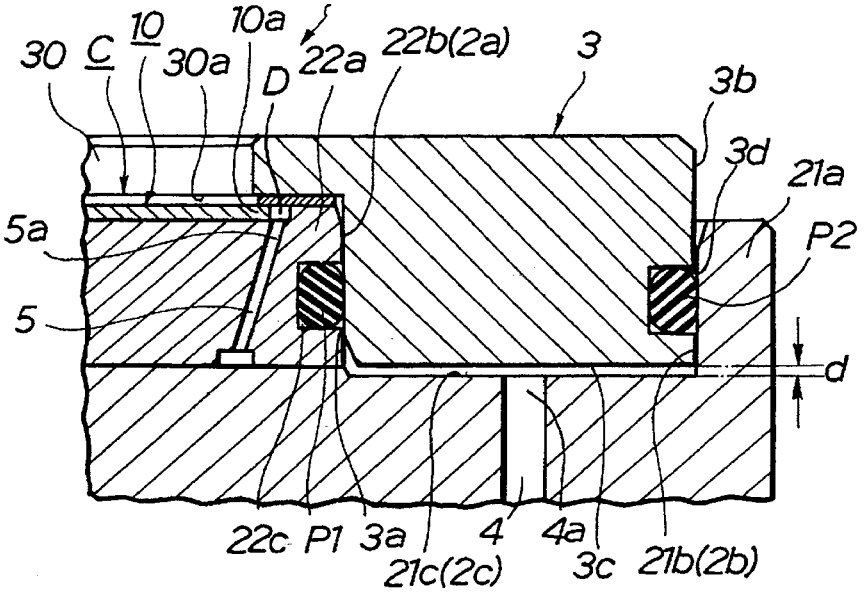
FIG. 2 is an enlarged sectional view of a portion of the first embodiment of the electroplating apparatus.
Figure 3:
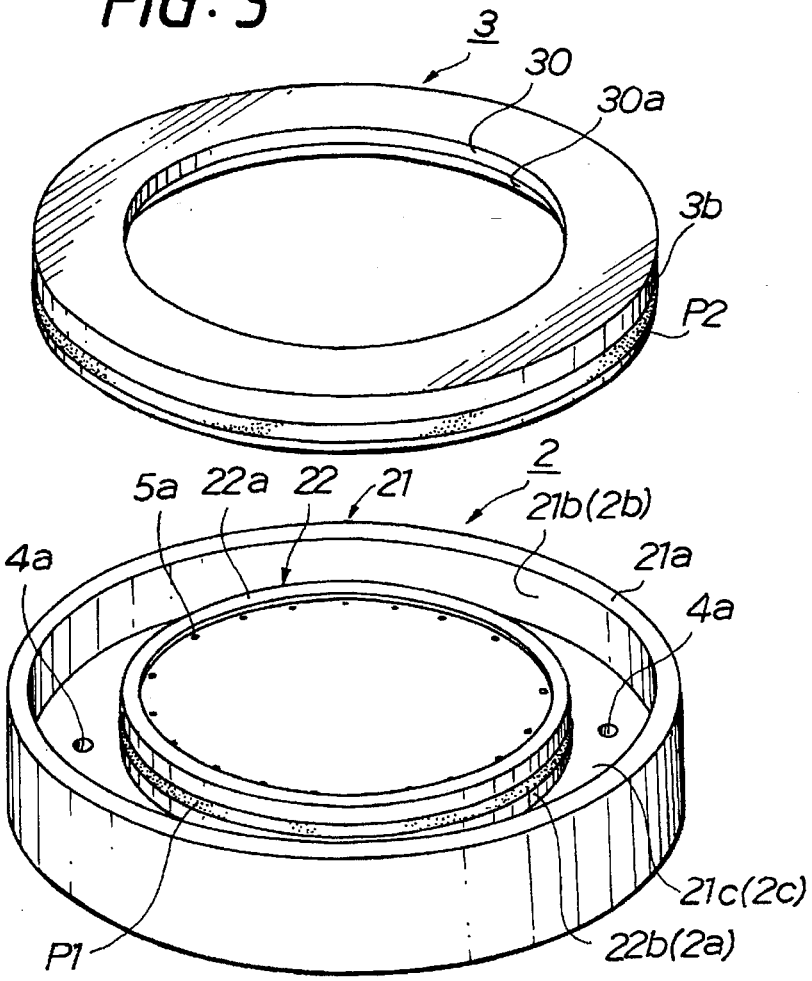
FIG. 3 is a perspective view showing a cathode substrate and a clamper of the first embodiment electroplating apparatus.

FIGS. 1 to 3 show a first embodiment of an electroplating apparatus which constitutes a part of a CD mastering apparatus according to the present invention. In those illustrations, reference numeral 1 denotes an electroplating apparatus; 10, a substrate to be plated; and C, a contact ring.

As shown in FIG. 1, the electroplating apparatus 1 generally comprises a cathode base 2 for supporting the substrate 10, and a clamper 3 disposed on the cathode base 2 and adapted to clamp a peripheral edge portion 10*a* of the substrate 10 against the cathode base 2.

The electroplating apparatus 1 further comprises a negative pressure source (not shown) for drawing the clamper 3 by negative pressure from beneath in order to clamp the substrate. The electroplating apparatus 1 further comprises a pressure source (not shown ) for pressurizing a gap D formed between the cathode base 2 and the clamper 3 with pressurized gas. This gap D communicates with a gap formed between the cathode base or the clamper 3 and the peripheral edge portion 10*a* of the substrate 10.

The cathode base 2 and the clamper 3 have side surface portions 2*a* and 2*b*, and side surface portions 3*a* and 3*b*, respectively. The side surface portions 2*a* and 2*b* are in contact with the side surface portions 3*a* and 3*b*, respectively. The cathode base 2 and the clamper 3 further have mutually opposing surfaces 2*c* and 3*c*, respectively. Packings P1 and P2 are disposed respectively between the side surface portions 2*a* and 3*a* and between the side surface portions 2*b* and 3*b* to prevent a drawing leak, which would otherwise occur during a drawing operation by a negative pressure source as later described, from occurring.

The cathode base 2 includes a primary base 21 having a round shape in a plan view and a secondary base (cathode electrode) 22, having a smaller diameter than that of the primary base 21, and placed on the primary base 21. A suction conduit 4 and a feed conduit 5 are arranged within the cathode base 2.

An upstanding peripheral wall 21*a* is formed on a peripheral edge portion of the primary base 21, thereby defining a recess for receiving therein the secondary base 22 placed thereabove, together with the clamper 3 as later described. An upstanding peripheral wall 22*a* is also formed on a peripheral edge portion of the secondary base 22. The substrate 10 is disposed inwardly of the peripheral wall 22*a*. In this embodiment, the side surface portions 2*a*, 2*b* and the opposing surface 2*c* of the cathode base 22 are formed by an inner surface portion 21*b* of the primary base 21, an outer surface portion 22*b* of the secondary base 22 and an upper surface portion 21*c* of the primary base 21, respectively. A groove 22*c* for receiving the packing P1 is formed in the outer surface portions 22*b* of the secondary base 22.

One end 4*a* of the suction conduit 4 is open at an upper surface of the primary base 21 and faces an opposing surface 3*c* located at a lower end of the clamper 3 as later described. The other end (not shown) of the suction conduit 4 is in communication with the negative pressure source (not shown).

One end 5*a* of the feed conduit 5 is open at an upper surface of the secondary base 22 and faces the gap D. The other end (not shown) of the feed conduit 5 is in communication with the pressure source (not shown).

As shown in FIG. 3, the clamper 3 has a ringshaped outer appearance. A protruding wall portion 30 extending toward the center of the clamper 3 is formed on an upper end portion of an inner side of the clamper 3. A groove 3*d* is formed in a side surface portion 3*b* as an outer peripheral portion of the clamper 3, so that the packing P2 can be fitted therein. The thickness of the clamper 3 is set such that a gap d is formed between the surface 3*c* of the clamper 3 and the opposing surface 2*c* of the cathode base 2 during the drawing operation by the negative pressure source (not shown).

In the electroplating apparatus 1 of this embodiment, a contact ring C is interposed between the clamper 3 and the substrate 10. Although a provision of this contact ring C is not indispensable, it is employed in order to attain favorable contact between the cathode base 2 and the substrate 10 and to achieve a stable conductive state. Accordingly, when the cathode base 2 and the clamper 3 are made with a high degree of accuracy and the contact relation between the cathode base 2 and the substrate 10 is favorable, the contact ring C can be eliminated.

Further, in this embodiment, owing to the provision of the contact ring C, the gap D serves as a gap communicating with a gap formed between either the secondary base 22 of the cathode base 2 or the contact ring C and the peripheral edge portion 10*a* of the substrate 10.

Also, in this embodiment, since the grooves 22*c* and 3*d* for receiving the packings P1 and P2 are formed respectively in the side surface portions 2*a* of the cathode 2 and the side surface portion 3*b* of the clamper 3, the packings P1 and P2 can reliably be fitted into the grooves 22*c* and 3*d*, respectively, by a resilient force. Moreover, the packings can be prevented from escaping during the assembling operation of the apparatus, and the assembling work can be performed without any interference.

An anode (not shown), a plating solution (not shown), the substrate 10, etc. employed in the electroplating apparatus 1 are known per se.

Next, the operation of the electroplating apparatus 1 of the first embodiment will be described together with its use.

First, the substrate 10 is placed on the cathode base 2 with its surface-to-be-plated facing upwardly and with its peripheral edge portion 10*a* located on the secondary base 22.

Then, the contact ring C is placed on the upper surface side of the peripheral edge portion 10*a* of the substrate 10 and the peripheral wall 22*a* of the secondary base 22 in such a manner as to be astride them.

Thereafter, the clamper 3 is positioned; the contact ring C is pressed down by a lower end face 30*a* of the protruding wall portion 30; and the peripheral edge portion 10*a* of the substrate 10 is clamped between the secondary base 22 and the protruding wall portion 30 through the contact ring C.

Subsequently, the negative pressure source (not shown) is actuated to draw the clamper 3 byway of the suction conduit 4, thereby reliably clamping the peripheral edge portion 10*a* of the substrate 10. At the time this drawing operation is made by the negative pressure source, since the gap d is formed between the surface 3*c* of the clamper 3 and the opposing surface c of the cathode base 2, the drawing force by the negative pressure source can act uniformly on the overall opposing surface 3*c* through the gap d. Owing to the provision of the gap d, room is created for absorbing any deformation even if the clamper 3 and the cathode base 2 are deformed by temperature change or some other reasons.

Further, the pressure source (not shown) is actuated to apply pressure by supplying pressurized gas through the feed conduit to the gap D which is formed between the cathode base 2 and the clamper 3 and which is in communication with the gap between either the secondary base 22 of the cathode base 2 or the contact ring C and the peripheral edge portion 10*a* of the substrate 10.

Then, in that state, a plating solution is supplied onto the substrate 10 and an anode (not shown) is additionally arranged so that the surface of the substrate 10 is plated by this plating solution. Since the gap D is pressed by the pressurized gas coming from the pressure source through the feed conduit 5 at the time the plating operation is made, entry of the plating solution into the gap D can reliably be prevented.

In this way, according to the electroplating apparatus 1 of the first embodiment, the clamper 3 is drawn by the negative pressure source through the suction conduit 4 and the peripheral edge portion 10*a* of the substrate 10 is reliably clamped between the cathode base 2 and the clamper 3 through the contact ring C. Accordingly, there can be obtained a more desirable uniform and strong clamping force compared with the conventional example, irrespective of temperature change.

Further, since the gap D is pressed by the pressurized gas coming from the pressure source through the feed conduit 5 so that entry of the plating solution into the gap D can reliably be prevented, the complicated maintenance, which was otherwise required in the prior art at the time the substrate is exchanged, is no longer required and a stable plating procedure can be obtained.

Furthermore, the gap d is formed between the surface 3*c* of the clamper 3 and the opposing surface 2*c* of the cathode base 2 at the time the clamper 3 is drawn by the negative pressure source so that the negative suction force acts uniformly on the overall opposing surface 3*c* of the clamper 3, and any leak of the negative pressure drawing by the negative pressure source can be prevented by the packings P1 and P2 which are disposed respectively between the side surface portions 3*a* and 3*b* of the cathode substrate 2. Accordingly, a more uniform and stronger clamping force can be obtained.

In the electroplating apparatus 1 of the first embodiment, the substrate 10 can be reliably clamped by a uniform and strong clamping force generated by the drawing operation made by the negative pressure source, and entry of the plating solution into the gap D can be prevented by the pressure source pressing the peripheral edge portion 10*a* of the substrate 10 with air pressure. However, since entry of the plating solution into the gap D can also be prevented merely by pressurizing the gap D with the air pressure coming from the pressure source through the feed conduit, it is possible to provide an electroplating apparatus comprising a cathode base provided with only a feed conduit similar to that of the above embodiment, a clamper, and a pressure source. Owing to this arrangement, any complicated maintenance work, which would otherwise be required in the prior art at the time the substrate is exchanged, is no longer required.

Figure 4A:
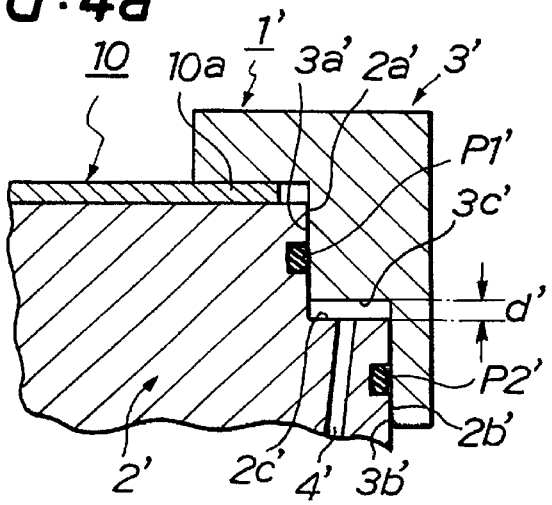
FIGS. 4*a* to 4*c* are sectional views of other embodiments of an electroplating apparatus according to the present invention, FIG. 4*a* being a sectional view showing a second embodiment of an electroplating apparatus of the present invention, FIG. 4*b* being a sectional view showing a third embodiment of an electroplating apparatus of the present invention, and FIG. 4*c* being a sectional view showing a fourth embodiment an electroplating apparatus of the present invention.
Figure 4B:
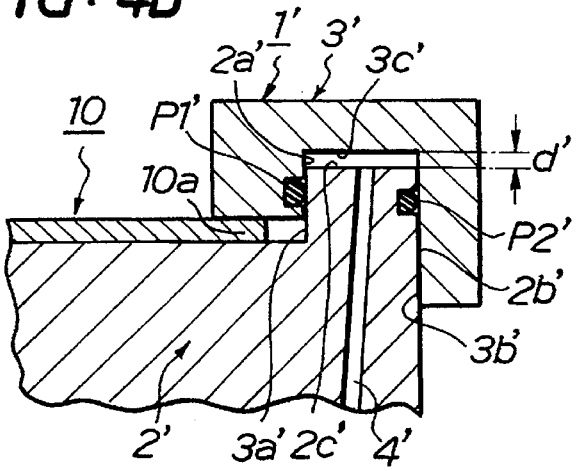
Figure 4C:
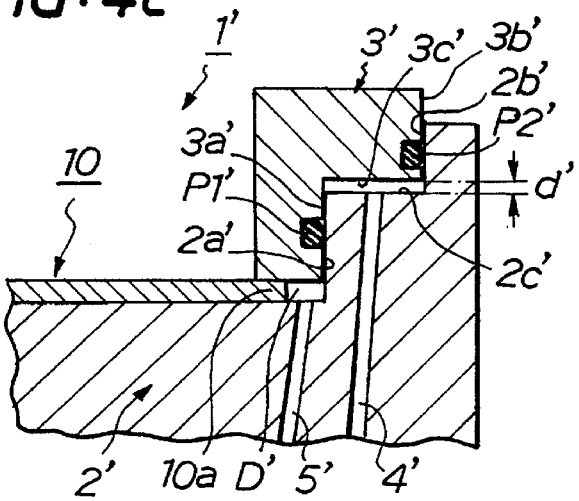

In the electroplating apparatus 1 of the first embodiment, the shape of the cathode base and clamper, the arrangement of the packings, or the arrangement of the suction conduit and feed conduit can be constructed in the same manner as the electroplating apparatus 1' of the second to fourth embodiments illustrated in FIGS. 4*a* to 4*c* (in FIGS. 4*a* to 4*c*, those portions corresponding to the electroplating apparatus 1 of the first embodiment are denoted by identical reference numerals affixed with "'").

Figure 5:
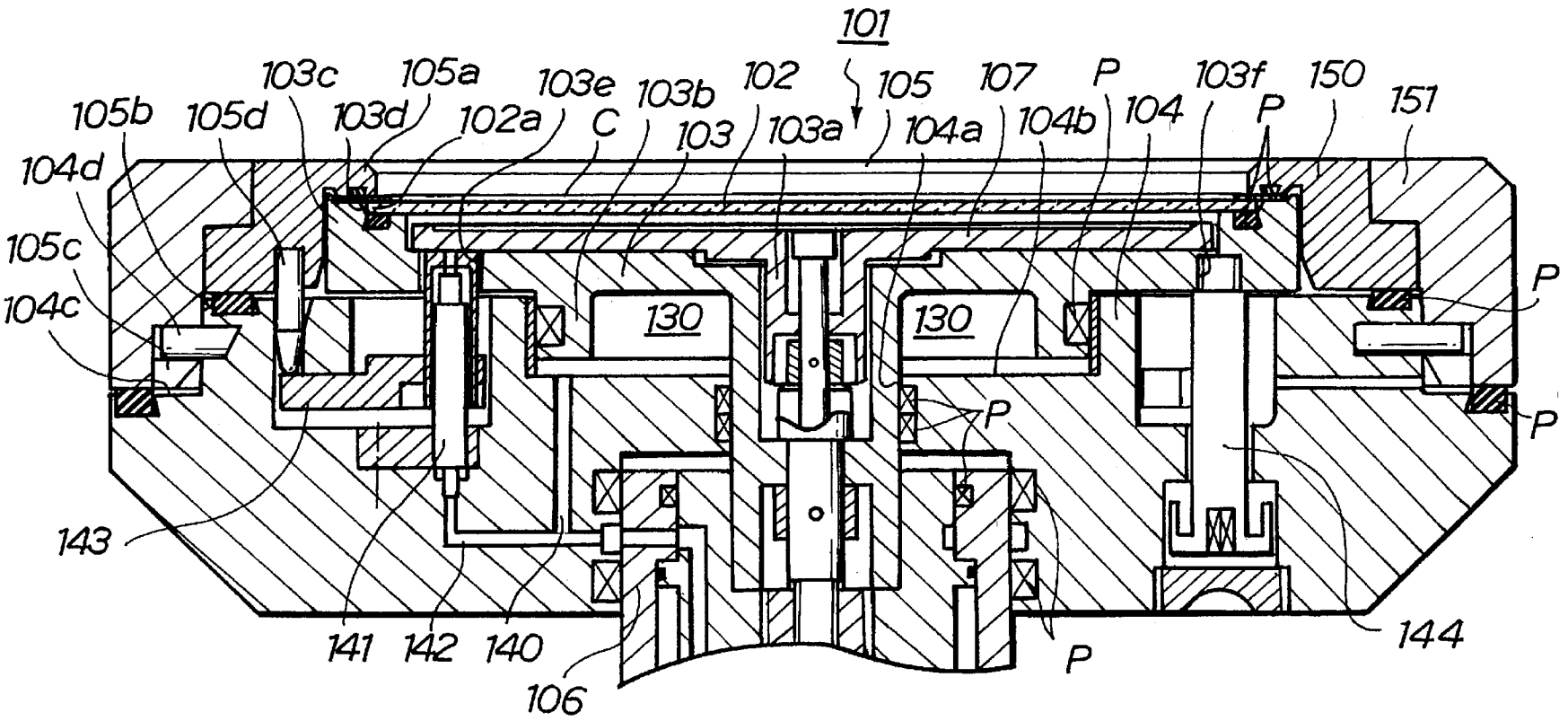
FIG. 5 is a front sectional view showing a fifth embodiment of an electroplating apparatus according to the present invention.

FIG. 5 shows an electroplating apparatus constituting a part of a CD mastering apparatus as a fifth embodiment of an electroplating apparatus according to the present invention. In the illustration, reference numeral 101 denotes an electroplating apparatus; 102, a substrate-to-be-plated; C, a contact ring; and P, a packing, respectively.

The term "cathode electrode" in the fifth to seventh embodiments described below and the term "secondary base" in the first to fourth embodiments described above denote the same member. The term "body" in the fifth to seventh embodiments and the term of primary base" in the first to fourth embodiments denote the same member.

As shown in FIG. 5, the electroplating apparatus 101 comprises a cathode electrode 103 for supporting a substrate 102, a body 104 disposed below a cathode electrode 103 for moving upwardly and downwardly relative to the cathode electrode 103; and a clamper 105 mounted on the body 104 and adapted to clamp a peripheral edge portion of the substrate 102 against the cathode electrode 103. Plating is applied to an upper surface of the substrate 102 by supplying a plating solution onto the substrate 102.

The cathode electrode 103 is provided on a lower surface thereof with a chamber 130, and the body 104 is provided therein with a first feed conduit 140 communicating with the interior of the body 104. Pressurized air is supplied into the chamber 130 through the feed conduit 140 so that the body 104 and the clamper 105 are moved downwardly with respect to the cathode electrode 103 to clamp the substrate 102.

The electroplating apparatus 101 will be described in more detail. The cathode electrode 103 has a round form in plan view and it also has a downwardly-extending wall portion 103*a* extending downwardly from a central portion of a lower surface thereof. The cathode electrode 103 also has a downwardly-extending wall portion 103*b* extending from the lower surface in such a manner as to surround the wall portion 103*a*. The chamber 130 forms a ring shape by the downwardly-extending wall portions 103*a* and 103*b*.

An upstanding wall portion 103*c* is formed on the peripheral edge portion of the upper surface of the cathode electrode 103. This upstanding wall portion 103*c* has a stepped portion 103*d* formed on an upper end portion thereof. A peripheral portion of the substrate 102 is placed on a lower stage of the stepped portion 103*d* and a contact ring C as later described is placed on an upper stage of the stepped portion 103*d*. The cathode electrode 103 is secured to an upper end portion of a shaft such that the cathode electrode 103 cannot move upwardly and downwardly. The cathode electrode 103 is provided with vertical insertion holes 103*e* and 103*f* into which an air cylinder 141 and a guide 144 as later described are inserted.

A carrier plate 107, which is lifted upwardly by the air cylinder 141 as later described, is disposed at a central portion of the cathode electrode 103. Before the clamper 105 is mounted on the body 104, the carrier plate 107 is lifted upwardly from the upstanding wall portion 103*c* of the cathode electrode 103. When the substrate 102 is placed on the carrier plate 107, it can be placed on the upstanding wall portion 103*c* of the cathode electrode 103 in a stable manner as the clamper 105 is mounted thereafter.

The body 104 has a round form in a plan view and an insertion hole 104*a* formed in a central portion thereof. A recess 104*b* is formed in a peripheral portion of an opening of the insertion hole 104*a* formed in the upper surface of the body 104. The downwardly-extending wall portion 103*a* of the cathode electrode 103 is inserted into the insertion hole 104*a* and an outer periphery of the downwardly-extending wall portion 103*b* is brought into slide contact with an inner surface of the recess 104*b*. A stepped portion 104*c* is formed on an outer peripheral portion of the body 104. Plural sets of engaging pins 104*d* projecting sidewardly are mounted on a surface portion of the upper stage side of the stepped portion 104*c*. The engaging pins 104*d* are brought into engagement with an engaging groove 105*c* of the clamper 105 as later described, thereby integrally mounting the clamper 105 on the body 104.

One end of the feed conduit 140 disposed within the body 104 is open at a lower portion of the chamber 130 and the other end communicates with a pressure source (not shown) such as a compressor through the inside of the shaft 106. The air cylinder 141 is disposed within the body 104 such that it is inserted into the insertion hole 103*e* of the cathode electrode 103. The air cylinder 141 is actuated by compressed air supplied through a branch conduit 142 branched from the feed conduit 140. The carrier plate 107 lifts the carrier plate 107 upwardly by a distal end portion of the air cylinder 141. A lifter ring 143 is secured to the air cylinder 141. When the clamper 105 is mounted on the body 104, the air cylinder 141 is lowered by a press pin 105*d* as later described so that the carrier plate 107 is lowered. The air cylinder 141 is provided with a leak mechanism so that the pressure in the air cylinder can be lowered when the clamper 105 is removed after the completion of the plating procedure. A guide 144 for restricting the rotation of the cathode electrode 103 by being inserted into the insertion hole 103*f* is mounted within the body 104. In the electroplating apparatus 101 of this embodiment, three air cylinders 141 and three guides 144 are employed.

The clamper 105 has a ring-like outer appearance, and a protruding wall portion 105*a* extending toward the center is formed on an upper end portion of the inner side of the clamper 105. The substrate 102 is clamped through the contact ring C against the upstanding wall portion 103*c* of the cathode electrode 103. A stepped portion 105*b* corresponding to the stepped portion 104*c* of the body 104 is disposed on a lower surface of the clamper 105. An engaging groove 105*c* engageable with the engaging pin 104*d* is formed in an inner surface of the stepped portion 105*b* of the clamper 105. This engaging groove 105*c* is a so-called twist lock type engaging groove in which the engaging pin 104*d* is locked when the clamper 105 is rotated through a predetermined angle. A press pin 105*d* extending downwardly is mounted on a lower surface of the stepped portion 105*b*, so that the lifter ring 143 is pressed downwardly when the clamper 105 is mounted. In this embodiment, the clamper 105 is constituted by an inner clamp 150 and an outer clamp 151.

In the electroplating apparatus 101 of this embodiment, the contact ring C is interposed between the clamper 105 and the substrate 102. Although the contact ring C is not indispensable, it is employed in order to achieve a favorable contact relation between the cathode electrode 103 and the substrate 102 and to stabilize the electrical conductivity. Accordingly, when the cathode electrode 103 and the clamper 105 are made with high accuracy and the contact state between the cathode electrode 103 and the substrate 102 is favorable, the contact ring C may be omitted.

Next, the operation of the electroplating apparatus 101 of the above embodiment will be described together with the use thereof.

First, the air cylinder 141 is activated to move the carrier plate 107 further upwardly of the cathode electrode 103. At that time, the clamper 105 is retreated to a noninterfering position. Then, the substrate 102 is placed on the carrier plate 107 with its surface-to-be-plated faced upwardly. Thereafter, the contact ring C is arranged upwardly of the substrate 102.

Then, the retreated clamper 105 is arranged upwardly of the carrier plate 107 and gradually lowered. At that time, the supply of compressed air to the air cylinder 141 is stopped and the carrier plate 107 is also lowered as the clamper 105 is lowered. Thereafter, the substrate 102 is placed such that a lower surface of the peripheral edge portion 102*a* is located on a lower stage of the stepped portion 103*d* of the upstanding wall portion 103*c* of the cathode electrode 103. Subsequently, the engaging pin 104*d* of the body 104 is brought into engagement with the engaging groove 105*c* of the clamper 105, and the clamper 105 is rotated through a predetermined angle so that the clamper 105 is reliably mounted on the body 104. At that time, the substrate 102 is clamped between the lower end face of the protruding wall portion 105*a* of the clamper 105 and the upstanding wall portion 103*c* of the cathode electrode 103 through the contact ring C. Since the carrier plate 107 is urged by the press pin 105*d*, the upward movement of the carrier plate 107 is restricted.

Then, the pressure source (not shown) is actuated to supply compressed air into the chamber 130 through the feed conduit 140. Thereafter, the body 104 and clamper 105 are moved downwardly of the cathode electrode 103 so that the peripheral edge portion 102*a* of the substrate 102 is reliably clamped.

Subsequently, a plating solution is supplied onto the substrate in that state and the anode (not shown) is arranged so that the surface of the substrate 102 is plated by the plating solution.

After the completion of the desired plating procedure, the surface of the substrate 102 is washed. Then, the supply of compressed air from the pressure source is stopped, and the clamper 105 is removed from the body 104. At that time, the leak mechanism (not shown) is actuated to reduce the pressure within the air cylinder 141 so that the carrier plate 107 is not accidentally moved upwardly.

After the clamper 105 has been removed and retreated to a predetermined position, the pressure source is actuated again to move the carrier plate upwardly by the air cylinder 141. Then, the contact ring C and the substrate 102 subjected to the plating procedure are taken out and the operation is finished.

In this way, according to the electroplating apparatus 101 of this embodiment, compressed air is supplied into the chamber 130 through the feed conduit 140, and the body 101 and clamper 105 are moved downwardly of the cathode electrode 103 so that the substrate 102 is clamped. Accordingly, the substrate 102 can more reliably be clamped by a uniform clamping force compared with the prior art, irrespective of temperature change. As a consequence, entry of the plating solution into a gap formed between either the cathode electrode 103 or clamper 105 and the peripheral edge portion 102*a* of the substrate 102 can reliably be prevented; complicated maintenance work, which would otherwise be required as in the prior art, is no longer required, and plating can be applied to the substrate 102 in a stable manner.

Figure 6:
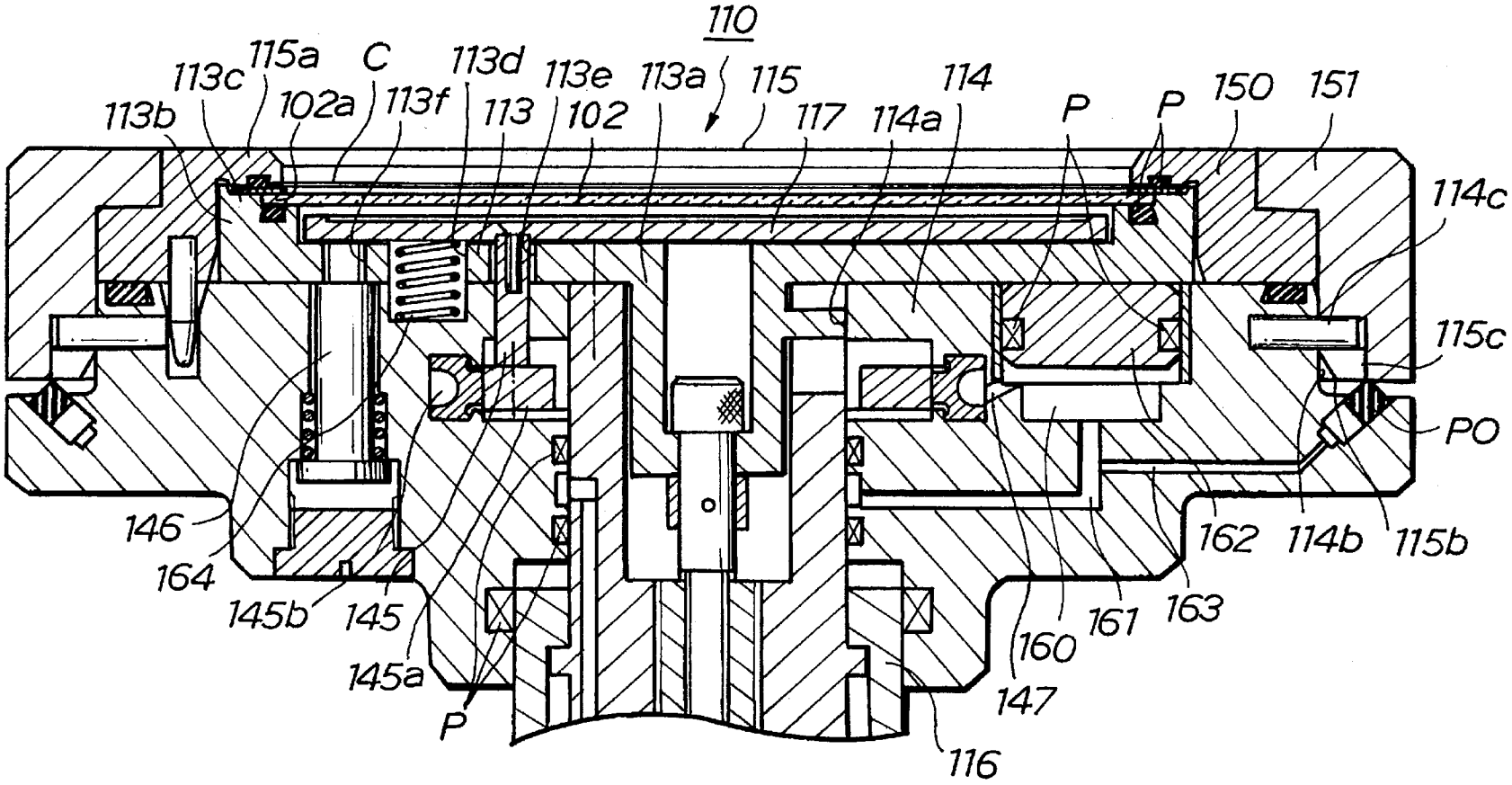
FIG. 6 is a front sectional view showing a sixth embodiment of an electroplating apparatus according to the present invention.

FIG. 6 shows a sixth embodiment of an electroplating apparatus according to the present invention. In the illustration, reference numeral 110 denotes an electroplating apparatus;, 102, a substrate; C, a contact ring; and P, a packing, respectively.

The electroplating apparatus 110 comprises a cathode electrode 113 for supporting the substrate 102, a body 114 disposed below the cathode electrode 113 such that the body 114 can move upwardly and downwardly relative to the cathode electrode 113, and a clamper 115 mounted on the body 114 and adapted to clamp a peripheral edge portion 102*a* of the substrate 102 against the cathode electrode 113.

A cylinder 160 is disposed within the body 114. An open end of the cylinder 160 faces a lower surface of the cathode electrode 113. A feed conduit 161 (first feed conduit), which communicates with the cylinder 160, is disposed within the body 104. A piston 162 is also disposed within the cylinder 160. Compressed air is supplied into the cylinder 160 through the feed conduit 161 to move the piston 162 upwardly .so that the piston 162 contacts a lower surface of the cathode electrode 113, and the body 114 and clamper 115 are moved downwardly relative to the cathode electrode 113 by the reaction so that the substrate 102 is clamped.

An endless ring-like packing P0 is disposed in a gap formed between the body 114 and the clamper 115. A feed conduit 163 (second feed conduit) one end of which faces the packing P0 is disposed within the body 114, and the body 114 and clamper 115 are sealed by pressing the packing P0 through the feed conduit 163.

The electroplating apparatus 110 will be described in more detail. The cathode electrode 113 has a round form in plan view and it also has a downwardly-extending wall portion 113*a* extending downwardly from a central portion of a lower surface thereof. The cathode electrode 113 is secured to the shaft 116 through the downwardly-extending wall portion 113*a*.

An upstanding wall portion 113*b* is formed on the peripheral edge portion of the upper surface of the cathode electrode 113. This upstanding wall portion 113*b* has a stepped portion 113*c* formed on an upper end portion thereof. A peripheral portion of the substrate 102 is placed on a lower stage of the stepped portion 113*c* and a contact ring C as later described is placed on an upper stage of the stepped portion 113*c*. The cathode electrode 113 is provided with vertical insertion holes 113*d*, 113*e* and 113*f* into which a spring 164, a carrier lifter 145 and a guide 146 as later described can be inserted.

A carrier plate 117, which is lifted upwardly by a biasing force of the spring 164, is disposed at a central portion of the cathode electrode 113. Before the clamper 115 is mounted on the body 114, the carrier plate 117 is lifted upwardly of the upstanding wall portion 113*b* of the cathode electrode 113. When the substrate 102 is placed on the carrier plate 117, the substrate 102 can be placed on the upstanding wall portion 113*b* of the cathode electrode 113 in a stable manner as the clamper 115 is mounted thereafter.

The body 114 has a round form in plan view and an insertion hole 114*a* formed in a central portion thereof. One open end of the cylinder 160 faces a lower surface of the cathode electrode 113 and the feed conduit 161 communicates with a downward location of the cylinder 160. A feed conduit for supplying compressed air to the outside of the stopper 145*b* is disposed on a side portion of the cylinder 160. A stepped portion 114*b* is formed on an outer peripheral portion of the body 114. Plural sets of engaging pins 114*c* projecting sidewardly are mounted on a surface portion of the upper stage side of the stepped portion 114*b*. The engaging pins 114*c* are brought into engagement with an engaging groove 115*c* of the clamper 115 as later described, thereby integrally mounting the clamper 115 on the body 114.

One end of the feed conduit 161 disposed within the body 114 is open at a downward location of the chamber 160 and the other end (not shown) communicates with a pressure source (not shown) such as a compressor through the inside of the shaft 116. The carrier lifter 145, which is inserted into the insertion hole 113*e* formed in the cathode electrode 113 and which has a distal end portion secured to the carrier plate 117, is disposed within the body 114. A ring-like lifter ring 145*a* is mounted on a lower end portion of the carrier lifter 145, and a ring-like stopper 145*b* is disposed on an outer side of the lifter ring 145*a*. Compressed air supplied through the feed conduit 147 leading from the cylinder 160 is supplied to outside the stopper 145*b* to urge the lifter ring 145*a* with the stopper 145*b*, thereby restricting the upward movement of the carrier plate 117. Further, the guide 146, which is to be inserted into the insertion hole 113*f* to restrict the rotation of the cathode electrode 113, is mounted within the body 114. In the electroplating apparatus 110 of this embodiment, three each of the cylinders 160, pistons 162, carrier lifters 145, springs 164 and guides 146 are provided.

One end of the feed conduit 163 disposed within the body 114 communicates with the feed conduit 161 and the other end faces outwardly from a lower stage surface of the stepped portion 114*b*. The packing P0 is disposed in the opening portion of the other end of the feed conduit 163. By supplying compressed air through this feed conduit 163, the packing P0 is brought into contact with the lower surface of the stepped portion 115*b* of the clamper 115 as later described, so that the gap formed between the body 114 and the clamper 115 is tightly sealed.

The clamper 115 has a ring-like outer appearance, and a protruding wall portion 115*a* extending toward the center is formed on an upper end portion of the inner side of the clamper 115. The substrate 102 is clamped through the contact ring C against the upstanding wall portion 113*c* of the cathode electrode 113. A stepped portion 115*b* corresponding to the stepped portion 114*b* of the body 114 is disposed on a lower surface of the clamper 115. An engaging groove 115*c* engageable with the engaging pin 114*c* is formed in an inner surface of the stepped portion 115*b* of the clamper 115. This engaging groove 115*c* is a so-called twist lock type engaging groove in which the engaging pin 114*c* is locked when the clamper 115 is rotated through a predetermined angle. A press pin 115*d* extending downwardly is mounted on a lower surface of the stepped portion 115*b*, so that the clamper 115 can easily be mounted. In this sixth embodiment, the clamper 115 is constituted by an inner clamp 150 and an outer clamp 151.

Also in the electroplating apparatus 110 of this sixth embodiment, the contact ring C is interposed between the clamper 115 and the substrate 102 as in the case with the electroplating apparatus 101 of the fifth embodiment. However, when the cathode electrode 113 and the clamper 115 are made with high accuracy and the contact state between the cathode electrode 113 and the substrate 102 is favorable, the contact ring C may be omitted.

Next, the operation of the electroplating apparatus 110 of the sixth embodiment will be described together with its use.

The supply of compressed air by the pressure source (not shown) is stopped and the carrier lifter 117 is lifted further upwardly of the cathode electrode 113 under the effect of the biasing force of the spring 164. At that time, the clamper 115 retreats to a non-interfering position. Then, the substrate 102 is placed on the carrier plate 117 with its surface-to-be plated facing upwardly. Thereafter, the contact ring C is arranged upwardly of the substrate 102 and then, the contact C is placed on the substrate 102. Subsequently, the carrier plate 117 is gradually lowered and the substrate 102 is placed such that a lower surface of the peripheral edge portion 102*a* is located on a lower stage of the stepped portion 113*c* formed on the upstanding wall portion 113*b* of the cathode electrode 113. In that state, the pressure source is actuated to supply compressed air through the feed conduit and conduit 147 so that the stopper is urged inwardly to restrict an upward lifting of the lifter ring 145*a*. Then, the retreated clamper 115 is arranged upwardly of the carrier plate 117 and gradually lowered. Then, the engaging pin 114*c* of the body 114 is brought into engagement with the engaging groove 115*c* of the clamper 115, and the clamper 115 is rotated through a predetermined angle so that the clamper 115 is reliably mounted on the body 114. At that time, the substrate 102 is clamped between the lower end face of the protruding wall portion 115*a* of the clamper 115 and the upstanding wall portion 113*b* of the cathode electrode 113 through the contact ring C.

Then, the supply of compressed air by the pressure source (not shown) is increased to further pressurize so that the piston 162 is moved upwardly of the cylinder. Then, the piston 162 is brought into contact with the lower surface of the cathode electrode 113 and the body 114 and clamper 115 are moved downwardly relative to the cathode electrode 113 by the reaction so that the peripheral edge portion 102*a* of the substrate 102 is reliably clamped.

Subsequently, a plating solution is supplied onto the substrate 102 in that state and the anode (not shown) is arranged so that the surface of the substrate 102 is plated by the plating solution.

After the completion of a desired plating procedure, the surface of the substrate 102 is washed. Then, the supply of compressed air from the pressure source is lessened to the extent that the clamper 115 can be removed from the body 114, so that the carrier plate 117 is not accidentally lifted upwardly.

After the clamper 115 has been removed and retreated to a predetermined position, the pressure source is stopped so that the stopper 145*b* stops urging the lifter ring 145*a*. Then the carrier plate 117 is lifted upwardly by the biasing force of the spring 164, the contact ring C and the substrate 102 subjected to the plating procedure are taken out and the operation is finished.

In this way, according to the electroplating apparatus 110 of this embodiment, compressed air is supplied into the cylinder 160 through the feed conduit 161, the piston 162 is brought into contact with the lower surface of the cathode electrode 113, and the body 114 and clamper 115 are moved downwardly relative to the cathode electrode 113 by the reaction so that the substrate 102 is reliably clamped.

Accordingly, the substrate 102 can be more reliably clamped by a uniform clamping force compared with the prior art, irrespective of temperature change. As a consequence, entry of the plating solution into a gap formed between either the cathode electrode 113 or clamper 115 and the peripheral edge portion 102*a* of the substrate 102 can reliably be prevented, complicated maintenance work, which would otherwise be required as in the prior art, is no longer required, and plating can be applied to the substrate 102 in a stable manner.

Since the gap formed between the body 114 and the clamper 115 is sealed by urging the packing P0 by supplying compressed air through the feed conduit 163, sealability between the body 114 and the clamper 115 can be enhanced without being adversely affected by temperature change. Accordingly, even if the electroplating apparatus 110 is dipped into the plating solution, entry of the plating solution through the gap formed between the body 114 and the clamper 115 can reliably be prevented.

Figure 7:
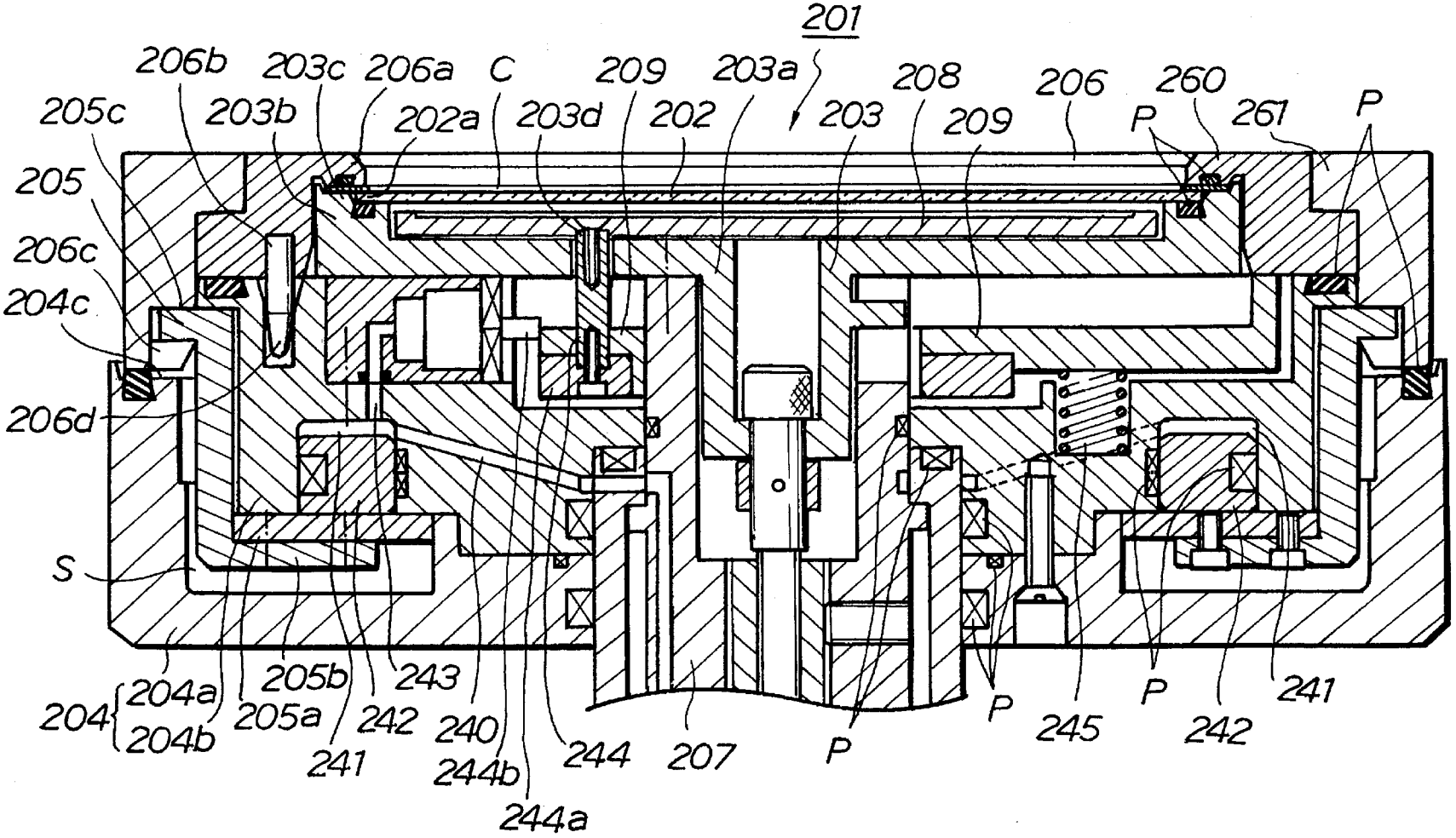
FIG. 7 is a front sectional view showing a seventh embodiment of an electroplating apparatus according to the present invention.

FIG. 7 shows an electroplating apparatus which constitutes a part of a CD mastering apparatus as a seventh embodiment of an electroplating apparatus according to the present invention. In the illustration, reference numeral 201 denotes an electroplating apparatus; 202, a substrate to be plated; C, a contact ring; and P, a packing, respectively.

As shown in FIG. 1, the electroplating apparatus 201 comprises a cathode electrode 203 for supporting the substrate 202, a body 204 disposed below the cathode electrode 203, an engaging jig 205 capable of moving upwardly and downwardly relative to the body 204, and a clamper 206 mounted on the substrate 202 through the engaging jig 205 and adapted to clamp a peripheral edge portion 202*a* of the substrate 202 against cathode electrode 203. A plating solution is supplied onto the substrate 202 so that the surface of the substrate 202 is plated.

The body 204 is provided therein with a feed conduit 240, one open end of which faces the engaging jig 205, and a cylinder chamber 241 is formed in one end portion of the feed conduit 240. The cylinder chamber 241 is provided therein with a piston 242. Compressed air is supplied into the cylinder chamber 241 through the feed conduit 240 so that the engaging jig 205 is lowered by the piston 242 and the clamper 206 is moved downwardly relative to the cathode electrode 204, thereby clamping the substrate 202.

The electroplating apparatus 201 will be described in more detail. The cathode electrode 203 has a round form in plan view and it also has a downwardly-extending wall portion of a lower surface thereof. The cathode electrode 203 is secured to the shaft 207 through the downwardly-extending wall portion 203*a*.

An upstanding wall portion 203*b* is formed on the peripheral edge portion of the upper surface of the cathode electrode 203. This upstanding wall portion 203 has a stepped portion 203*c* formed on an upper end portion thereof. A peripheral portion of the substrate 202 is placed on a lower stage of the stepped portion 203*c* and a contact ring C as later described is placed on an upper stage of the stepped portion 203*c*. The cathode electrode 203 is provided with a vertical insertion hole 203*d* into which the carrier lifter 244 as later described is inserted.

A carrier plate 208 is disposed at a central portion of the cathode electrode 203 and is adapted to deliver the substrate 202 by way of a connection with the lifter plate 209 which is lifted upwardly by a biasing force of the spring 245 as later described. Before the clamper 206 is mounted on the body 204, the carrier plate 208 is lifted upwardly of the upstanding wall portion 203*b* of the cathode electrode 203. When the substrate 202 is placed on the carrier plate 208, it can be placed on the upstanding wall portion 203*b* of the cathode electrode 203 in a stable manner as the clamper 105 is mounted thereafter.

The body 204 has a round form in plan view and an insertion hole formed in a central portion thereof. The body 204 comprises a primary base 204*a* and a secondary base 204*b* secured to the primary base 204*a*. A ring-like moving space S for allowing the engaging jig 205 as later described to move upwardly and downwardly is provided between the primary base 204*a* and the secondary base 204*b*. The cylinder chamber 241 is formed as a ring-shape at one end portion of the feed conduit 240 and below the secondary base 204*b*. The opening portion of the cylinder chamber 241 faces the engaging jig 205. A feed conduit 243 for supplying compressed air to outside a stopper 244*b* as later described is disposed at an upper location of the cylinder chamber 241. The piston 242 has a ring-like form corresponding to the cylinder chamber 241. The piston 242 has a ring-like form corresponding to the cylinder chamber 241. By means of a supply of compressed air through the feed conduit 240, the piston 242 urges an engaging jig 205, as later described, downwardly. A stepped portion 204*c* is formed on the peripheral edge portion of the body 204 such that the peripheral edge portion of the secondary base 204*b* is higher than the peripheral edge portion of the primary base 204*a*.

One end portion of the feed conduit 240 disposed within the body 204 is defined by the cylinder chamber 241 and the other end portion (not shown) communicates with a pressure source (not shown) such as a compressor through the inside of the shaft 207. The carrier lifter 244, which is inserted into the insertion hole 203*d* formed in the cathode electrode 203 and which has a distal end portion secured to the carrier plate 208, is disposed within the body 204. A lower end portion of this carrier lifter 244 is secured to a lower surface of the lifter plate 209 together with a ring-like lifter ring 244*a*. A pin-like stopper 244*b* is disposed outside the lifter ring 244*a*. Compressed air supplied through the feed conduit 243 leading from the cylinder chamber 241 is supplied to outside the stopper 244*b* and the lifter ring 244*a* is urged by the stopper 244*b*, thereby restricting the upward lifting of the carrier plate 208. In the electroplating apparatus 201 of this embodiment, three each of the carrier lifters 244, stoppers 244*b*, and springs 245 are provided.

The engaging jig 205 comprises a clamp ring 205*a* located downwardly of the cylinder chamber 241, and a plurality of engaging pins 205*b* secured to the clamp ring 205. The engaging portion 205*c* of each engaging pin 205*b* is provided such that it projects outwardly from a side surface of a peripheral edge portion of the secondary base 204*b*. Then, the engaging portion 205*c* of this engaging pin 205*b* is brought into engagement with the engaging groove 206*c* of the clamper 206 as later described, so that the clamper 206 can be integrally mounted on the body 204.

The clamper 206 has a ring-like outer appearance, and a protruding wall portion 206*a* extending toward the center is formed on an upper end portion of the inner side of the clamper 206. The substrate 202 is clamped through the contact ring C against the upstanding wall portion 203*c* of the cathode electrode 203. A stepped portion 206*b* corresponding to the stepped portion 204*c* of the body 204 is disposed on a lower surface of the clamper 206. An engaging groove 206*c* engageable with the engaging portion 205*c* of the engaging pin 205*b* is formed in an inner surface of the stepped portion 206*b* of the clamper 206. This engaging groove 206*c* is a so-called twist lock type engaging groove in which the engaging pin 204*c* is locked when the clamper 206 is rotated through a predetermined angle. A press pin 206*d* extending downwardly is mounted on a lower surface of the stepped portion 206*b*, so that the clamper 206 can easily be mounted. In this embodiment, the clamper 206 comprises an inner clamper 260 and an outer clamper.

In the electroplating apparatus 201 of this seventh embodiment, the contact ring C is interposed between the clamper 206 and the substrate 202 as is the case with the electroplating apparatus of the earlier embodiments. When the cathode electrode 203 and the clamper 206 are made with high accuracy and the contact state between the cathode electrode 203 and the substrate 202 is favorable, the contact ring C may be omitted.

Next, the operation of the electroplating apparatus 201 of the seventh embodiment will be described together with a use thereof.

The supply of compressed air by the pressure source (not shown) is stopped and the carrier plate 208 is lifted further upwardly of the cathode electrode 203 under the effect of the biasing force of the spring 245. At that time, the clamper 206 retreats to a non-interfering position. Then, the substrate 202 is placed on the carrier plate 208 with its surface-to-be plated faced upwardly. Thereafter, the contact ring C is arranged upwardly of the substrate 202, and then the contact C is placed on the substrate 202.

Then, the retreated clamper 206 is arranged upwardly of the carrier plate 208 and gradually lowered. Then, the carrier plate 208 is gradually lowered by pressing the peripheral edge portion of the lifter plate 209 with the stepped portion 206*b* of the clamper 206. Thereafter, the substrate 202 is placed such that the lower surface of the peripheral edge portion 202*a* is located at a lower stage of the stepped portion 203*c* on the upstanding wall portion 203*b* of the cathode electrode 203. In that state, the pressure source is actuated to supply compressed air through the feed conduits 240 and 243, so that the stopper 244*b* is urged inwardly to restrict an upward lifting of the lifter ring 244*a* of the carrier lifter 244.

Subsequently, the engaging portion 205*c* of the engaging pin 205*b* of the body 204 is brought into engagement with the engaging groove 206*c* of the clamper 206, and the clamper 206 is rotated through a predetermined angle so that the clamper 206 is reliably mounted on the body 204. At that time, the substrate 202 is clamped between the lower end face of the protruding wall portion 206*a* of the clamper 206 and the upstanding wall portion 203*b* of the cathode electrode 203 through the contact ring C.

Then, the supply of compressed air by the pressure source (not shown) is increased to further pressurize so that the piston 242 is moved downwardly of the cylinder chamber 241. Then, the piston 242 is brought into contact with the upper surface of the clamp ring 205*a* to urge the engaging jig 205 downwardly and the clamper 206 is moved downwardly relative to the cathode electrode 203 so that the peripheral edge portion 202*a* of the substrate 202 is reliably clamped.

Subsequently, a plating solution is supplied onto the substrate 202 in that state and the anode (not shown) is arranged so that the surface of the substrate 202 is plated by the plating solution.

After the completion of a desired plating procedure, the surface of the substrate 202 is washed. Then, the supply of compressed air from the pressure source is lessened to the extent that the clamper 206 can be removed from the body 204, so that the carrier plate 208 is not accidentally lifted upwardly.

After the clamper 206 has been removed and retreated to a predetermined position, the pressure source is stopped so that the stopper 244*b* stops urging the lifter ring 244*a*. Then the lifter plate 209 is lifted upwardly by the biasing force of the spring 245, the carrier plate 208 is lifted upwardly, the contact ring C and the substrate 202 subjected to the plating procedure are taken out and the operation is finished.

In this way, according to the electroplating apparatus 201 of this embodiment, compressed air is supplied into the cylinder chamber 241 through the feed conduit 240, the piston 242 is lowered to urge the engaging jig 205 downwardly, and the body 204 and clamper 206 are moved downwardly relative to the cathode electrode 203 that the substrate 202 is reliably clamped. Accordingly, the substrate 202 can more reliably be clamped by a uniform clamping force compared with the prior art, irrespective of temperature change. As a consequence, entry of the plating solution into a gap formed between either the cathode electrode 203 or clamper 206 and the peripheral edge portion 202*a* of the substrate 202 can reliably be prevented, complicated maintenance work, which would otherwise be required as in the prior art, is no longer required, and a plating can be applied to the substrate 202 in a stable manner.

Further, in the electroplating apparatus 201, since the engaging jig 205 is pressed downwardly through the piston 242, the pressing force can uniformly act on the engaging jig 205, the engaging jig 205 can reliably be pressed downwardly and the engaging jig 205 is not obliged to take a complicated form.

The anode (not shown), plating solution (not shown), substrate, etc. in the electroplating apparatus according to the present invention may be selected from those known per se.

The electroplating apparatus according to the present invention may appropriately be changed in dimension, shape, etc. without departing from the object of the present invention.

For example, in the fifth and sixth embodiments, three each of the air cylinders 141 and guides 144 (electroplating apparatus 101 of the fifth embodiment), and the cylinders 140, pistons 142, carrier lifters 145, springs 144, and guides 146 (electroplating apparatus 110 of the sixth embodiment) are employed. It should be noted, however, the number of those component parts is not limited to three, but it may appropriately be changed in accordance with the shape, etc. of the substrate, clamper and body.

In the seventh embodiment, three each of the carrier lifters 244 and springs 245 are employed. It should be noted, however, that the number of those component parts is not limited to three, but it may appropriately be changed in accordance with the shape, etc. of the substrate, clamper and body.

Furthermore, in the seventh embodiment of the present invention, the engaging jig 205 is pressed downwardly by the piston 242 disposed within the cylinder chamber 241 of the body 204. It should be noted, however, that this arrangement may be changed such that the piston 242 is secured to the clamper spring 205*a* of the engaging jig 205, or the engaging jig 205 is integrally formed with the piston 242, so that compressed air from the feed conduit 240 is supplied to the engaging jig 205 in order to press it downwardly. In that case, substantially the same effects as the above embodiment can be obtained.

Moreover, in the respective embodiments mentioned above, a so-called O-ring is used as the packing. It should be noted, however, that other shapes of packings may be employed such as, for example, an X-shaped packing having an X-shape in section, a U-shaped packing having a U-shape in section, or the like.

The electroplating apparatus according to the present invention is, of course, not limited in application to the electroplating apparatus which constitutes the CD mastering apparatus of the above respective embodiments. It may favorably be used, for example, as an electroplating apparatus for plating a substrate such as a photomagnetic disk or the like.

According to the electroplating apparatus of the present invention, the following effects can be obtained.

According to the electroplating apparatus, the clamper is drawn by the negative pressure source through the suction conduit and the peripheral edge portion of the substrate is clamped by the clamper and the cathode base. By virtue of this arrangement, the substrate can more reliably be clamped compared with the prior art, irrespective of temperature change. The reliable clamping of the peripheral edge portion of the substrate ensures a reliable prevention of entry of a plating solution into the gap formed between either the cathode base or clamper and the peripheral edge portion of the substrate. As a consequence, complicated maintenance work such as for wiping out the plating grown on the cathode base, etc., which would otherwise be required at the time the substrate is exchanged as in the prior art, is no longer required. Thus, plating can be applied to the substrate in a stable manner.

Since the suction conduit is provided in the cathode base, the external structure of the apparatus does not become complicated, and the conduit does not hinder the mounting or dismounting of the clamper in addition to the effects described above.

A gap is formed between the opposing surfaces of the clamper and the cathode base when the clamper is drawn by the negative pressure source, so that the negative drawing force by the negative pressure source acts uniformly on the overall opposing surface of the clamper through this gap. By virtue of this arrangement, there can be obtained a more uniform and stronger clamping force, in addition to the effects described above.

The gap formed between the cathode base and the clamper, which communicates with the gap formed between either the cathode base or clamper and the peripheral edge portion of the substrate, is pressurized by a pressurized gas coming from the pressure source through the feed conduit. By virtue of this arrangement, entry of the plating solution into the gap formed between either the cathode base or clamper and the peripheral edge portion of the substrate can more reliably be prevented, in addition to the effects described above.

Leakage of the negative drawing force by the negative pressure source is prevented by the packing disposed between the side surface portion of the clamper and the side surface of the cathode base. By virtue of this arrangement, there can be obtained a stronger clamping force, in addition to the effects described above.

According to the electroplating apparatus, the gap formed between either the cathode base or clamper and the peripheral edge portion of the substrate is pressurized by a pressurized gas coming from the pressure source through the feed conduit, so that the entry of the plating solution into the gap can reliably be prevented. By virtue of this arrangement, complicated maintenance work, such as wiping out the plating grown on the cathode base, etc., which would otherwise be required at the time the substrate is exchanged as in the prior art, is no longer required.

Compressed air is supplied to the chamber through the feed conduit so that the body and clamper are moved downwardly relative to the cathode electrode in order to clamp the substrate. By virtue of this arrangement, the substrate can reliably be clamped by a more uniform clamping force compared with the prior art, irrespective of temperature change. The reliable clamping of the substrate ensures a reliable prevention of the entry of a plating solution into the gap formed between either the cathode electrode or clamper and the substrate. As a consequence, complicated maintenance work, such as wiping out the plating grown on the cathode electrode, etc., which would otherwise be required at the time the substrate is exchanged as in the prior art, is no longer required. Thus, plating can be applied to the substrate in a stable manner.

Entry of the plating solution from the gap formed between the body and the clamper can reliably be prevented irrespective of temperature change, in addition to the effects described above.

What is claimed as new and is desired to be secured by Letters Patent of the United States is:

1. An electroplating apparatus comprising:

a cathode base having a surface for supporting a substrate and a channel surrounding said surface;

a clamper for clamping a peripheral edge portion of said substrate against said cathode base, said clamper being received in said channel; and a negative pressure source for clamping said substrate by drawing said clamper under a negative pressure through a suction conduit;

a plating solution being supplied onto said substrate so that the surface of said substrate is plated.

2. An electroplating apparatus according to claim 1, wherein said suction conduit is provided in said cathode base.

3. An electroplating apparatus according to claim 1, wherein said cathode base and said clamper include mutually contacting side surfaces, and opposing surfaces continuous with said side surface portions and opposing to each other, respectively; and wherein said cathode base and said clamper further include a gap formed between said opposing surfaces and communicating with said suction conduit during a drawing operation by said negative pressure source.

4. An electroplating apparatus according to claim 2 wherein said cathode base and said clamper include mutually contacting side surfaces, and opposing surfaces continuous with said side surface portions and opposing to each other, respectively; and wherein said cathode base and said clamper further include a gap formed between said opposing surfaces and communicating with said suction conduit during a drawing operation by said negative pressure source.

5. An electroplating apparatus according to claim 1, further comprising a pressure source for pressurizing a gap formed between said cathode base and said clamper under the effect of a pressurized gas through a feed conduit.

6. An electroplating apparatus according to claim 2, further comprising a pressure source for pressurizing a gap formed between said cathode base and said clamper under the effect of a pressurized gas through a feed conduit.

7. An electroplating apparatus according to claim 3, further comprising a pressure source for pressurizing a gap formed between said cathode base and said clamper under the effect of a pressurized gas through a feed conduit.

8. An electroplating apparatus according to claim 4, further comprising a pressure source for pressurizing a gap formed between said cathode base and said clamper under the effect of a pressurized gas through a feed conduit.

9. An electroplating apparatus according to claim 3, wherein packings are provided between the side surface portions of said cathode base and the side surface portions of said clamper.

10. An electroplating apparatus according to claim 4, wherein packings are provided between the side surface portions of said cathode base and the side surface portions of said clamper.

11. An electroplating apparatus according to claim 7, wherein packings are provided between the side surface portions of said cathode base and the side surface portions of said clamper.

12. An electroplating apparatus according to claim 8, wherein packings are provided between the side surface portions of said cathode base and the side surface portions of said clamper.

13. An electroplating apparatus comprising:

a cathode base having a surface for supporting a substrate and a channel surrounding said surface;

a clamper for clamping a peripheral edge portion of said substrate together with said cathode base, said clamper being received in said channel; and a pressure source for pressurizing a gap formed between said cathode base and said clamper under the effect of pressurized gas through a feed conduit, said gap communicating with a gap formed between either said cathode base or clamper and the peripheral edge portion of said substrate;

a plating solution being supplied onto said substrate so that the surface of said substrate is plated.

14. An electroplating apparatus comprising:

a cathode electrode for supporting a substrate;

a body disposed below said cathode electrode for moving upwardly and downwardly relative to said cathode electrode and a clamper mounted on said body and adapted to clamp a peripheral edge portion of said substrate against said cathode electrode; and a pressure source for supplying compressed air through a first feed conduit so that said body and said clamper are moved downwardly with respect to the cathode electrode to clamp said substrate.

15. An electroplating apparatus according to claim 14, wherein a chamber is provided on a lower surface of said cathode electrode or on an upper surface of said body, said first feed conduit communicates with said chamber, and compressed air is supplied to said chamber.

16. An electroplating apparatus according to claim 14, wherein a cylinder is provided on a lower surface of said cathode electrode or on an upper surface of said body, a piston is provided within said cylinder, and said first feed conduit is communicated with said cylinder; and compressed air is supplied to said cylinder through said first feed conduit so that said piston is moved upwardly to contact a lower surface of said cathode electrode and so that said body and said clamper are moved downwardly with respect to said cathode electrode to clamp said substrate.

17. An electroplating apparatus according to claim 14, wherein packing is interposed between said body and said clamper, said body being provided therein with a second feed conduit one end of which faces said packing, said packing being urged through said second feed conduit 143 so that said body and said clamper are sealed.

18. An electroplating apparatus according to claim 15, wherein packing is interposed between said body and said clamper, said body being provided therein with a second feed conduit one end of which faces said packing, said packing being urged through said second feed conduit so that said body and said clamper are sealed.

19. An electroplating apparatus according to claim 16, wherein packing is interposed between said body and said clamper, said body being provided therein with a second feed conduit one end of which faces said packing, said packing being urged through said second feed conduit so that said body and said clamper are sealed.

* * * * *